United States Patent [19]

Fenwick

[11] 4,139,917

[45] Feb. 20, 1979

[54] LABOR, DELIVERY AND PATIENT CARE BED

[76] Inventor: Loel Fenwick, P.O. Box 3211, Spokane, Wash. 99220

[21] Appl. No.: 842,958

[22] Filed: Oct. 17, 1977

[51] Int. Cl.[2] ..... A61G 13/00

[52] U.S. Cl. ..... 5/66; 5/91; 5/60; 269/325

[58] Field of Search ..... 269/323, 325; 5/60, 5/66–69, 91; 128/298, 361

[56] References Cited

U.S. PATENT DOCUMENTS

| | | | |
|---|---|---|---|
| 2,275,973 | 3/1942 | Marchbanks | 5/66 |
| 2,647,026 | 7/1953 | Shampaine | 269/325 |
| 3,138,805 | 6/1964 | Piazza | 5/60 |
| 3,593,350 | 7/1971 | Knight | 5/66 |
| 4,057,240 | 11/1977 | Damico et al. | 269/325 |

FOREIGN PATENT DOCUMENTS

| | | | |
|---|---|---|---|
| 497662 | 12/1938 | United Kingdom | 5/66 |

*Primary Examiner*—Casmir A. Nunberg
*Attorney, Agent, or Firm*—Wells, St. John & Roberts

[57] ABSTRACT

A bed for obstetrical and similar purposes, having a rigid support frame in two releasable modules which mounts a series of relatively movable mattress sections. When latched end-to-end, the two modules and the mattress sections are capable of being adjusted to various configurations to comfortably support a patient for labor, delivery and normal hospital care purposes. A center mattress section is movably supported on pivoted braces connected to the bed support frame. An upper mattress section is pivotably connected to the center section, and a lower mattress section is movably mounted to the bed support frame. Elevational adjustment is available between the abutting ends of the center and lower sections to expose the patient's pelvic area. When necessary, the two modules can be detached from one another and leg supports can be used to provide access for difficult deliveries or other operations.

12 Claims, 11 Drawing Figures

LABOR, DELIVERY AND PATIENT CARE BED

BACKGROUND OF THE INVENTION

The practice of American maternity care customarily uses a series of facilities to cater for the series of events occurring during a mother's hospital stay. Most mothers can expect to be cared for in:

a preparation room where admission procedures are performed.

a labor room where they are usually confined to a conventional hospital bed, one not ideally suited for either labor or delivery. Then, at both an emotionally and physically crucial stage of labor, the mother is transferred to a delivery room. This movement necessitates the interruption of fetal monitoring, constitutes a potentially hazardous transfer from bed to stretcher to table, and creates an inconvenient situation for everyone concerned.

a delivery room which resembles an operating room and can, therefore, be very disconcerting to an alert, unsedated patient. The delivery table, designed during the "twilight sleep" era when all patients were sedated and most underwent forceps delivery, is not suited to today's minimally anesthetized patient who desires personal involvement in a more physiologic delivery. Since the design dictates that the patient undergo delivery with her legs suspended in supports, the conventional delivery table precludes the adoption of the upright or reclining posture. Not only do women who are not restrained tend to seek this posture, but studies have shown that a more upright posture produces both better alignment of the pelvis and more effective labor. Besides being embarrassing to the patient the lithotomy position can produce decreased placental perfusion by compression of the maternal vena cava. The patient's breathing is impaired in this position and she is unable to use her arm, chest and abdominal muscles to full advantage. To allow early mother-child contact, the baby is often placed on the mother's abdomen which, because of the narrowness of the table, is the only available space. From a standpoint of both safety and ease of nursing, this is less than ideal.

the baby is then routinely sent to a nursery regardless of the need for any special care, primarily because the mother is unable to care for her infant while on the delivery table. This creates the need for nursery space to care for well babies, deprives the parents of early contact with their child and exposes the baby to the risk of nursery acquired infections.

a recovery room — used in some hospials. Here the mother remains for a short time after delivery.

a post-partum ward, to which they are transferred by stretcher and where they remain for one to three days after an uncomplicated vaginal delivery.

The logistics of this sytem include either five or six different rooms, continuous patient transfers, multiple changes of bedclothes, coordination of information between labor room, nursery and post-partum ward personnel and an impersonal, assembly line experience for the mother.

This disclosure relates to a special purpose hospital bed designed to serve the needs of both the hospial staff and patient during both labor and delivery, as well as during the usual hospital stay following the birth of a child. It provides an all-purpose bed for gynecological and obstetrical purposes, or for other pelvic operations on both male and female patients.

This bed eliminates the need for transferring a patient from one bed to another or from one room to another for various normal procedures. It particularly lends itself to the use of regional anesthesia during birth and adapts well to the needs presented by prepared childbirth programs. It takes into consideration the emotional, physical and aesthetic requirements of the patient, and serves to simplify and expedite childbirth. Its successful utilization in a maternity program should reduce the average hospital stay required by childbirth without compromising the physical needs of both the patient and attending medical personnel.

The bed further provides the patient with the type of support now available in a specialized obstetric chair or "birth chair," where the patient can comfortably assume a seated posture best calculated for successful natural childbirth. Finally, should the need arise, the patient can be placed in the lithotomy position by separating the two bed frame modules to provide adequate exposure for forceps delivery or other reasons.

Single-room short stay maternity care can do more than any other concept to provide safe childbearing at reduced cost. This has been demonstrated in many centers throughout the country, and an increasing number are moving in this direction, with many notable successes. The major impediment to more universal acceptance of this method has been the inability to achieve satisfactory safety for all patients undergoing different complexities of vaginal delivery. Most facilities therefore limit the use of childbearing rooms to only those mothers considered to be at low risk. While their safety record has been generally impressive, there remains the possibility of patient endangerment in the event of a sudden unexpected emergency. This risk, though small, has understandably been the major factor limiting general national adoption of the concept.

The multipurpose childbearing bed disclosed herein makes it possible for all women undergoing either straightforward or complicated vaginal delivery to have the same or greater safety than that previously only attainable in a system of specialized rooms. As the need for cesarean section now constitutes the only absolute contraindication to delivery in a childbearing room equipped with a multipurpose bed, the single-room system can now be safely used by almost 90% of all mothers.

Conservatively, a 30% reduction in hospital maternity costs can be achieved by using a system of short stay childbearing rooms. Far greater savings have been reported by many centers, and these do not yet have multipurpose beds. Regardless of all other benefits mentioned, the possibility of providing better, safer care while reducing the national hospital maternity bill of around four billion dollars deserves consideration.

Already many maternity care centers are proliferating around the country, not because of insufficient hospital space but because hospitals will not provide the type of desired safe care at an affordable cost. If hospitals do not move decisively and soon to become more responsive, this duplication of facilities will inevitably push the cost of hospital care even higher.

DESCRIPTION OF THE PREFERRED EMBODIMENT

Figure 1:
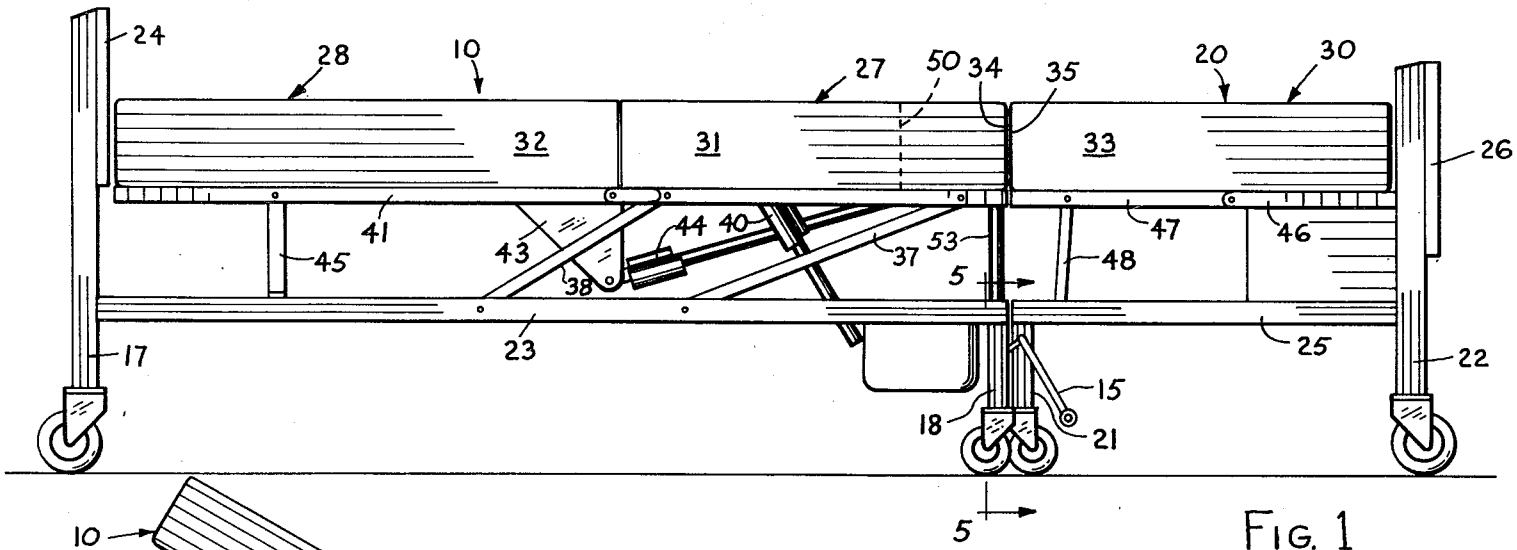
FIG. 1 is a side view of the bed.

The bed shown in the drawings is a physical embodiment of a structural design to make safe, single-room maternity care a reality. The bed has the versatility to meet all normal requirements of a maternity patient from admission to hospital discharge. It is particularly adapted to the needs of short-stay maternity centers, and permits the users to fully utilize the advantages of prepared childbirth programs with or without the use of local anesthesia.

The bed incorporates the features of a labor bed, an obstetric chair, a delivery bed, an operative-delivery table, a post-delivery bed, and an intensive care bed in a single, full-sized, comfortable bed that is aesthetically compatible with a patient's room. It permits the patient to remain in common, familiar and reassuring surroundings through and after childbirth. This eliminates a major source of patient endangerment and permits uninterrupted fetal monitoring.

The bed basically comprises a system of movable patient support surfaces which can be positioned relative to one another to achieve different positions of the patient without transferring the patient to a surgical table, a delivery table or other appliances not an integral part of the bed itself. It assists the patient in achieving a sitting or reclining position in which the patient's trunk, pelvis and legs are each supported by surfaces of diminishing elevation. These surfaces are an integral part of the upper surface of the bed and are the same surfaces which would normally support the patient in a supine or lateral position. Under normal conditions, the patient can be effectively supported in the bed for delivery without the use of leg supports, pillows or extraneous backrests. The bed also presents an interlocking indentation and projection along the patient support surfaces which are movable in relation to one another to present a centrally located space for access to the patient and/or delivery of a baby.

In describing the features of the bed, reference will be made to the respective ends of the bed as being the "head" and "foot" ends in relation to the head and feet of a patient using it. Longitudinal direction will refer to that direction along the bed between its head and foot. The various longitudinal relationships between the bed sections will be referred to as an "upper" end directed toward the head of the bed and a "lower" end directed toward the foot of the bed. Transverse directions shall be perpendicular or across the longitudinal direction.

Figure 3:
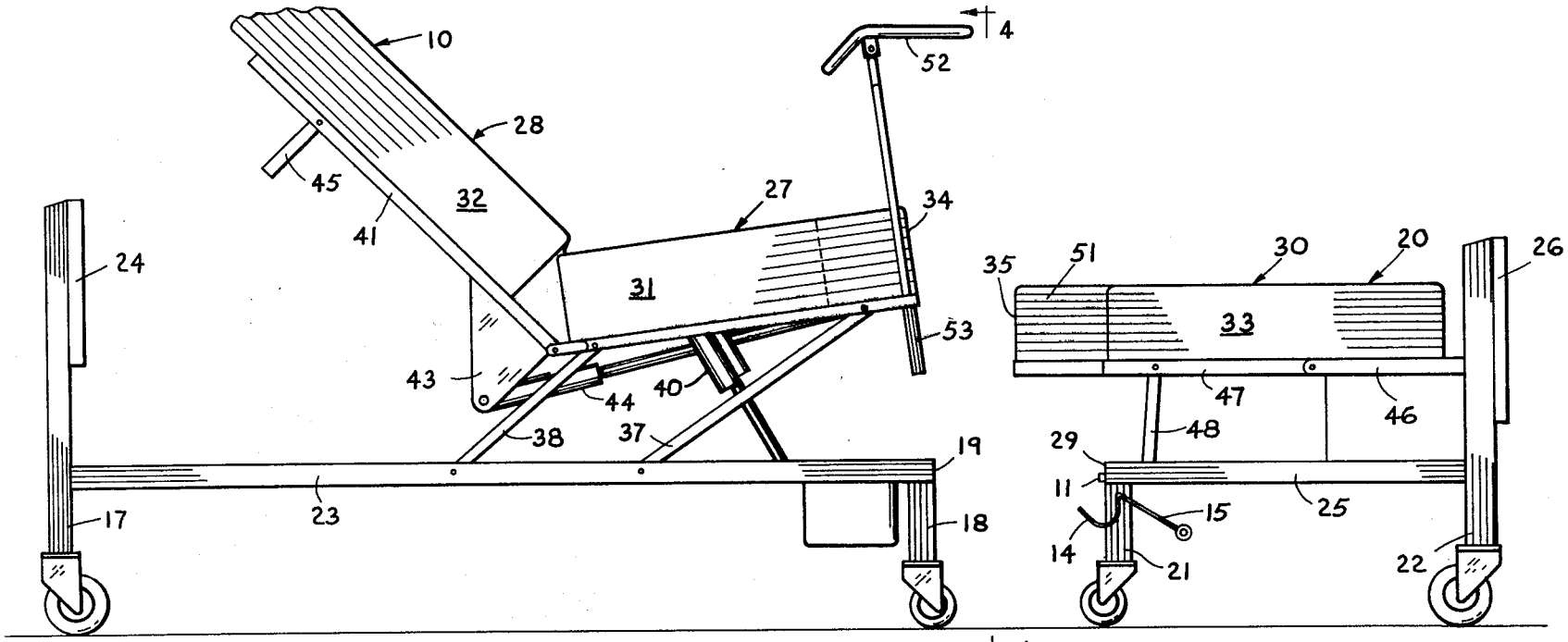
FIG. 3 is a side view of the separated bed modules.
Figure 4:
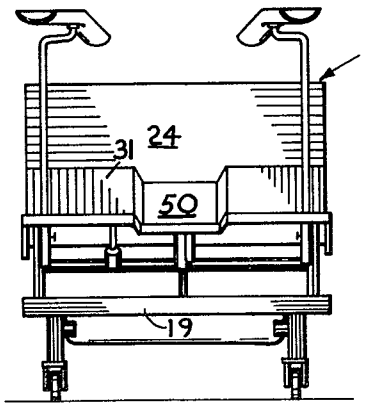
FIG. 4 is a reduced end view taken along line 4—4 in FIG. 3.

The specific bed structure shown in the drawings utilizes separable modules in the bed frame. A first bed frame module 10 includes the head of the bed and a second bed frame module 20 includes the foot of the bed. These two modules 10, 20 can be attached to one another to form a full length bed (FIG. 1) or can be released or separated from one another for independent movement and usage about a floor surface (FIG. 3).

The first bed frame module 10 specifically comprises an open rectangular framework including a pair of horizontal side rails 23. They are spanned at their upper ends by a fixed headboard 24 and at their lower ends by a transvere horizontal member 19. The module 10 is supported by four corner legs, the upper legs being designated as 17 and the lower legs being designated as 18. The legs 17, 18 are provided with conventional casters to facilitate movement of the bed frame module. The legs and casters provide supports engageable with the floor surface in the area in which the bed is used.

The second bed frame module 20 also is provided with an open rectangular framework including parallel horizontal side rails 25. They are joined at their lower ends by a fixed footboard 26 and at their upper ends by a transverse horizontal member 29. Legs 21, 22 support module 20.

The horizontal open frameworks of the two bed frame modules 10, 20 have a common elevation relative to the floor surface supporting them. The side rails 23 and 25 are transversely spaced an identical amount in both modules to provide two open frameworks having widths common to one another.

Figure 7:
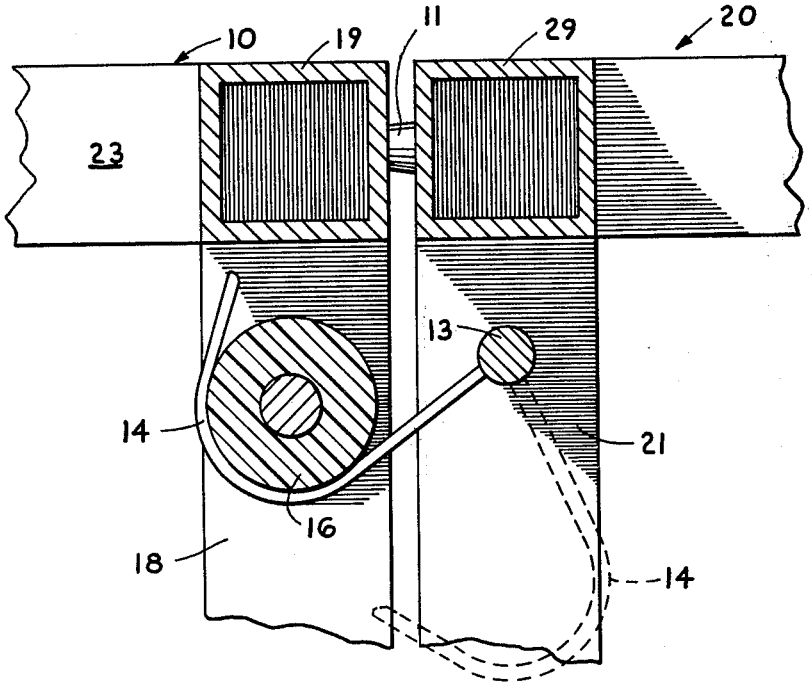
FIG. 7 is an enlarged fragmentary sectional view taken along line 7—7 in FIG. 5.

A releasable latch assembly is provided on the bed frame modules 10, 20. It is used for alternatively attaching a first end of each module to one another in an end-to-end relationship to form a full length bed or for releasing the bed frame modules from one another for independent movement of the bed frame modules. The latch assembly shown in the drawings comprises a transverse rotatable shaft 13 carried by the upper legs 21 of the second bed frame module 20. A pair of bent hooks 14 protrudes outward from shaft 13 for engagement about matching resilient rollers 16 rotatably mounted to the lower legs 18 of the first bed frame module 10 (see FIGS. 5, 7). Shaft 13 can be manually pivoted with respect to legs 21 by means of a handle 15. The axis of shaft 13 is elevationally above the axes of the roller 16 to provide an over-center relationship with respect to the axis of rollers 16 to prevent the hooks 14 from slipping downward when engaged.

Figure 5:
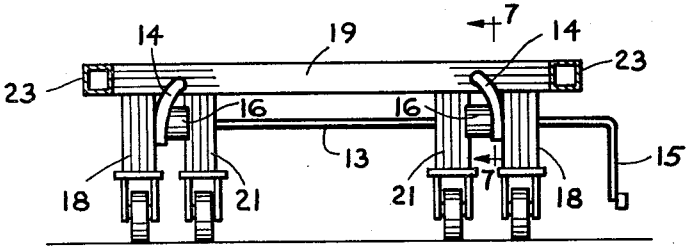
FIG. 5 is a sectional view taken along line 5—5 in FIG. 1.

Resilient bumpers 11 are provided across the transverse horizontal member 29 at the first end of module 20 and are slightly compressed when the hooks 14 are in engagement about rollers 16. This eliminates any longitudinal movement between the modules 10, 20. Lateral movement is prevented by hooks 14, which are inwardly curved so as to wedge against the inner surfaces of legs 18 as the hooks 14 are pivoted upwardly into full engagement about the rollers 16 (FIG. 5). This maintains the modules 10, 20 in accurate longitudinal alignment.

Figure 2:
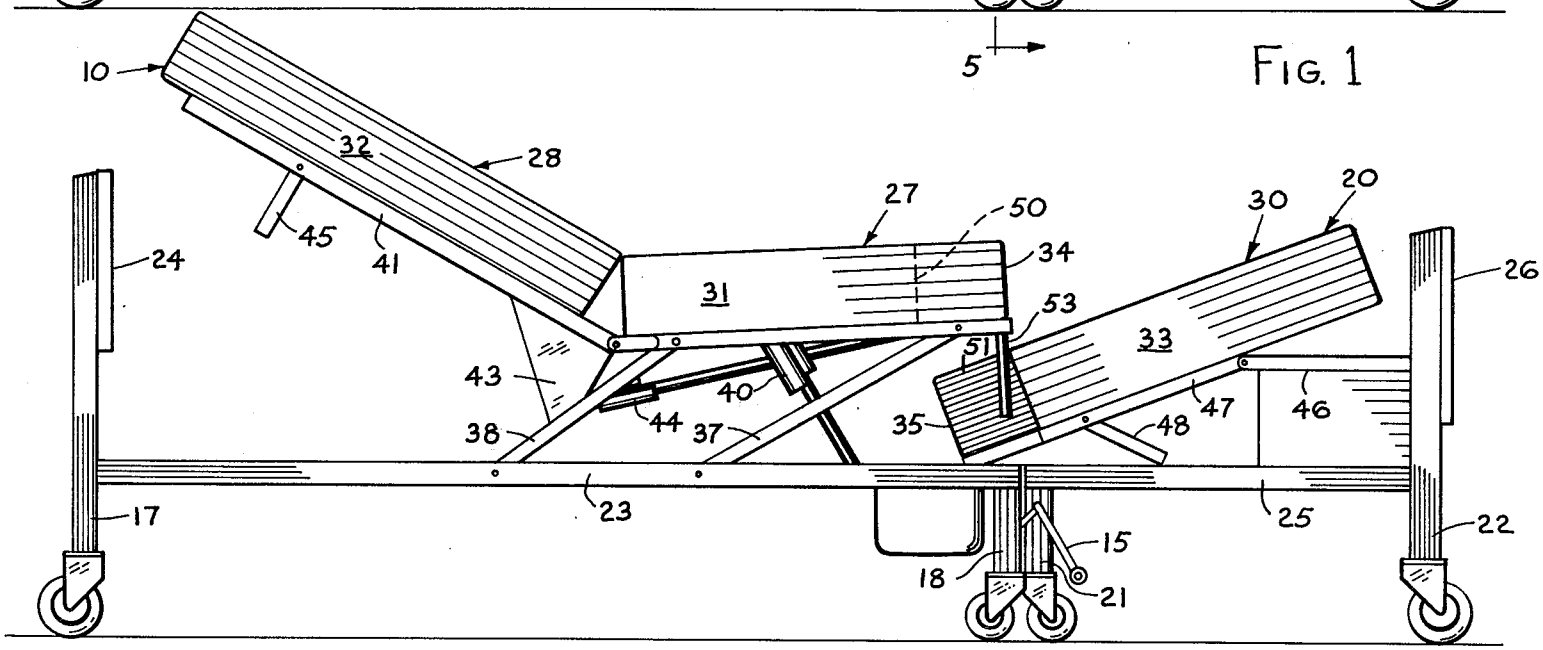
FIG. 2 is a side view with the mattress sections shown in a second condition.

FIGS. 1 and 2 show the two modules attached to one another in longitudinal alignment. This is the condition in which the bed will be normally used for most purposes. However, when it is necessary to provide longitudinal access to the bed and patient, the modules 10, 20 are readily releasable from one another by pivoting handle 15 in a counterclockwise direction as seen in FIG. 3, enabling either module to be moved relative to the other. This will be discussed more fully below.

The first bed frame module 10 supports a first mattress assembly adapted for support of the head, trunk and pelvis of a patient. This includes a center section 27 and an upper section 28. The second mattress assembly, which is carried on the second bed frame module 20 is adapted to support the legs and feet of a patient when the two bed frame modules 10, 20 are attached to one another by the latch assembly. The second mattress assembly comprises a lower mattress section shown generally at 30. The mattress assemblies respectively include a center cushion 31, an upper cushion 32, and a lower cushion 33.

The first mattress assembly presents a transverse end edge 34 across the lower end of the center cushion 31. A complementary transverse end configuration is presented across the upper end of the cushion 33 and is indicated in the drawings at 35. The complementary transverse end edges 34, 35 of the respective mattress assemblies are capable of abutting one another when at a common elevation to present a continuous patient support surface.

Means are provided between the first bed frame module 10 and the center and upper mattress sections 27, 28 and between the second bed frame module 20 and the lower mattress section 30 for selectively locating the three mattress sections in the following alternative configurations relative to the bed frame modules 10, 20 while they remain attached to one another:

(a) a first condition (FIG. 1) in which the patient support surfaces of the upper, center and lower mattress sections 27, 28 and 30 are coplanar;

(b) a second condition (FIG. 8) in which the center mattress section 27 is raised relative to the first bed frame module 10 and lower mattress section 30 to a position in which its lower transverse end 34 is elevationally above the upper transverse end 35 of the lower mattress section 30;

(c) a third condition (FIG. 2) in which the lower mattress section 30 is lowered relative to the second bed frame module 20 and the center mattress section 31 to a position in which its upper transverse end 35 is elevationally lower than the lower transverse end 34 of center mattress section 31;

(d) a fourth condition (FIGS. 2, 8 and 10) in which the patient support surfaces along upper mattress section 28 are inclined upwardly and outwardly in a longitudinal direction leading from the transverse upper end across the center mattress section 27;

(e) a fifth condition (FIG. 11) in which the upper and center mattress sections 27, 28 are coplanar and inclined downwardly in a direction leading from the lower transverse end 34 of the center mattress section 27 to the upper transverse end of the upper mattress section 27.

Figure 11:
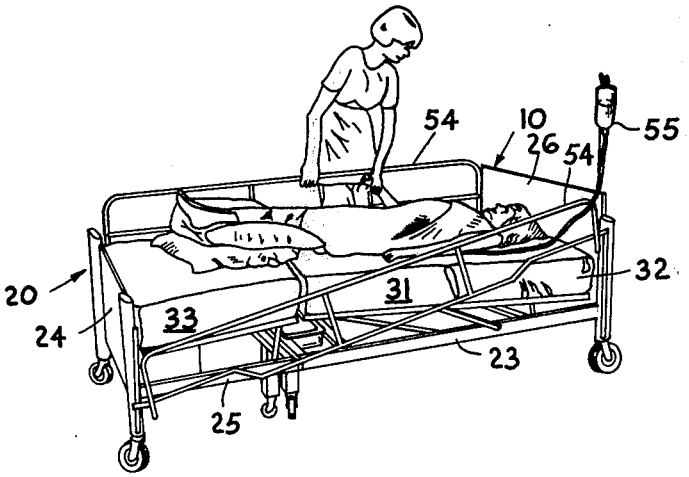

The center cushion 31 of the center mattress section 27 rests upon a rectangular plate 36 which is movably supported on side rails 23 by pivoted lower and upper braces 37, 38. The plate 36, rails 23 and braces 37, 38 comprise a parallelogram support assembly with the lower braces 37 slightly longer than the upper braces 38. This difference in length causes an inclination of center plate 36 and cushion 31 when plate 36 is raised from its horizontal position (FIG. 1) to an elevated condition (FIG. 3) or is lowered from the horizontal position to a depressed position (FIG. 11). Elevational movement of center plate 36 is accomplished by means of a conventional jack screw assembly 40 connected between the framework of module 10 and the lower surfaces of the plate 36. The assembly 40 can be motor driven by either electric or hydraulic motors, or can be hand cranked.

The upper mattress section 28 includes a cushion 32 which rests upon a rectangular plate 41. The lower transverse end of plate 41 is pivotally connected to the upper transverse end of plate 36 for movement about a pivotal axis designated as 42. Angular adjustment between the plates 36, 41 is effected through a second jack screw assembly 44 extending between a bracket 43 fixed to the lower surface of plate 41 and the under surface of center plate 36.

The upper plate 41 is also partially supported by rigid pivotable legs or supports 45 which normally extend downwardly perpendicular to plate 41 as shown in FIGS. 1 through 3. The supports 45 are in vertical alignment with the respective side rails 23 and rest on the side rail surfaces when the upper plate 41 is in a horizontal lowered position (FIG. 1). However, the supports 45 can be folded toward plate 41 to enable the upper center mattress sections to be inclined downwardly toward the head of the bed (FIG. 11).

The lower mattress section 30 includes a lower fixed plate 46 and a pivotal plate 47 mounted to the second bed frame module 20. Plate 47 is pivoted directly to plate 46 about a transverse horizontal axis. Its upper end is provided with a pair of pivotable legs or supports 48 in vertical alignment with the side rails 25. They are pivoted about a transverse axis between an upstanding condition (FIGS. 1 and 3), in which the plates 46, 47 are coplanar and horizontal. They can be folded to permit plate 47 to be inclined as shown in FIG. 2. In place of the two plates 46, 47, a single pivotal plate can be mounted to the second bed frame module 20 to produce a similar support for the cushion 33, enabling it to be moved from a horizontal condition to one in which its upper transverse end edge 35 is elevationally lower than the adjacent mattress cushion 31.

Figure 6:
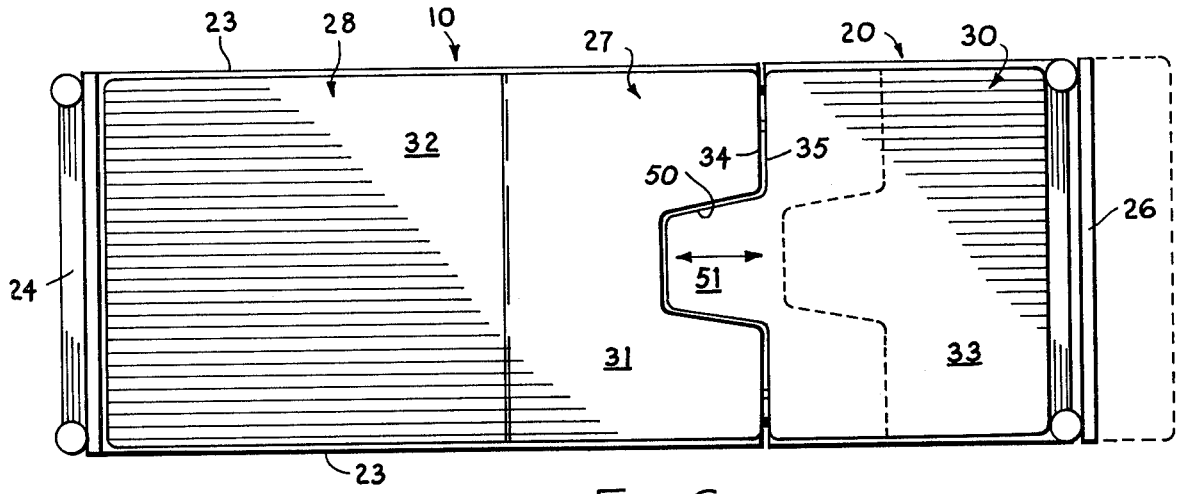
FIG. 6 is a plan view of the bed.

FIG. 6 illustrates the details of the transverse end edges 34, 35 formed across the respective center and lower cushions 31, 33. The center cushion 31 has a central indentation 50 formed therein. It extends inwardly from the transverse side edges formed across the lower end of cushion 31. Its width and depth are adapted to provide practical working access to the pelvic areas of a patient and to facilitate childbirth by providing an opening in alignment with the patient's birth canal.

The transverse end 35 on cushion 33 has a central projection 51 extending outwardly from its transverse edges. Projection 51 is complementary in plan to the shape of indentation 50. Projection 51 is adapted to fit within the indentation 50 when the respective transverse end edges 34, 35 of the first and second mattress assemblies are in abutment with one another as shown in full lines in FIG. 6. Three methods are available for opening the area within indentation 50. First, the projection 51 and indentation 50 are movable relatively in a longitudinal direction (FIG. 3). Secondly, cushion 33 can be lowered relative to cushion 31 (FIG. 2). Thirdly, the center cushion 31 can be elevated (FIG. 8).

Various conventional obstetrical and hospital attachments can be used with this bed. The most important of these are leg supports 52 which are detachable and which can be readily secured within brackets 53 at the lower corners of the center plate 36 (see FIG. 3). Side rails 54 can also be secured to the bed frame modules 10, 20 as illustrated in FIG. 11. Various monitoring or intravaneous devices 55 can also be mounted to the frame elements as illustrated generally in FIGS. 10 and 11.

The illustrated bed is designed to be used in a multipurpose room for childbirth and gynecological operations, as well as other pelvic surgical procedures. It is designed to eliminate the need for transferring a patient from a bed to a cart to an operating table and back again. Its many adjustment features allow the patient and attendants to choose a comfortable, psychologic posture, thereby reducing emotional stress. Labor therefore becomes a more satisfying and better-tolerated experience with enhanced rapport and cooperation between all involved.

Figure 8:
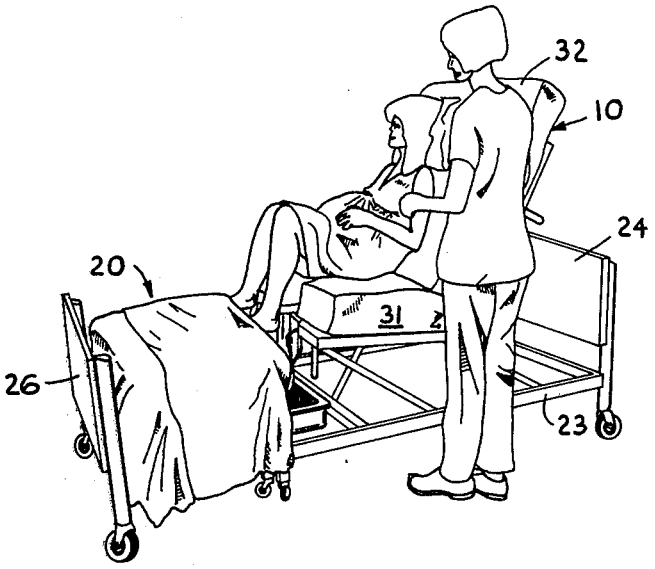
FIGS. 8 through 11 are pictorial views illustrating use of the bed.

The usual position of a patient during labor is illustrated in FIG. 8. The center mattress section 27 is elevated above the lower section 30, which can either remain horizontal or be inclined downwardly. The upper mattress section 28 is pivoted to an inclined position in which it supports the patient's back in a sitting posture. The relative elevational movement between the center mattress section 27 and the lower mattress section 30 opens the area within indentation 50 and permits easy vaginal examination and application of fetal monitoring apparatus. The patient's back, pelvis and feet are comfortably supported by cushioned surfaces. She can remain in a bedroom environment during labor, which is pyschologically comfortable and reassuring.

During the later stages of labor and during delivery, the reclining position shown in FIG. 8 permits the mother to make full effective use of maternal expulsive forces and gravity in the direction of pelvic curvature. Pressure on the maternal vena cava and diaphragm are reduced, producing better perfusion of mother and fetus. Studies by others have shown that the upright posture during labor products more efficient and rapid labor with decreased need for the use of oxytocics and forceps deliveries.

Figure 10:
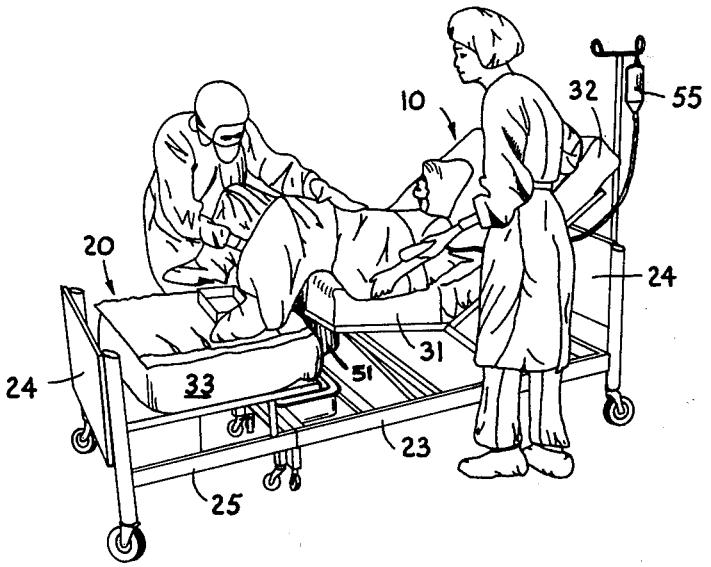

As illustrated in FIG. 10, most vaginal deliveries can be safely and easily accomplished without placing a patient's legs in supports. The jack screw assemblies 40, 44 can be used to raise the center mattress section 27 and upper mattress section 28 to comfortable working heights, further exposing the patient's perineum at the open area within indentation 50. This provides adequate exposure and maneuverability for assisting in even difficult shoulder deliveries.

After delivery, the bed can be readily returned to a conventional bed configuration with the upper section 28 either inclined comfortably or coplanar with the center and lower mattress sections 27, 30.

Figure 9:
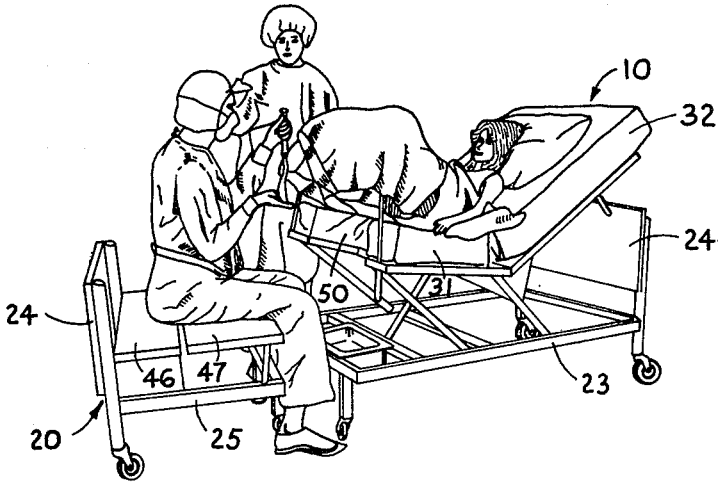

All the safety of a conventional delivery table is immediately available when using this bed. It is compatible with the use of local, regional, conduction and general anesthesia. As shown in FIG. 9, should the need arise, the patient can be placed in the lithotomy position with her legs in conventional support assemblies 52. The two modules 10, 20 can be quickly separated by operation of handle 15 to release the hooks 14 from the rollers 16. The lower mattress section 30 can then be moved out of the way or can be used by the attending physician as a stool. With the lower mattress section 30 separated from the first bed frame module, adequate exposure is provided for forceps delivery or episiotomy repair. The lower cushion 33 of the separated second bed frame module 20 is also readily usable as a table for immediate newborn examination.

The bed can be converted for intensive care in minutes, by collapsing the pivotable supports 45 at the upper end of plate 41 and lowering the center and upper mattress sections 27, 28 by operation of jack screw assembly 40. The head of the bed lowers in this manner to produce Trendelenberg's position (FIG. 11). Side rails 54 and intravenous stands 55 can be used to provide added security to mother and infant. Again, this is effected without transferring the patient from one bed to another or otherwise disturbing her psychological peace of mind due to the familiar setting in which all of these positions and operational modifications are achieved.

Having described my invention, I claim:

1. A combination labor, delivery and patient care bed comprising:

a bed framework extending longitudinally between a head end and a foot end and having leg supports engageable with a floor surface;

a first mattress assembly mounted on said framework for support of the head, trunk and pelvis of a patient;

said first mattress assembly having parallel transversely spaced side edges extending between a first transverse end at the head end of the framework and a second transverse end intermediate the head and foot ends thereof;

a transversely centered indentation extending inward from the second transverse end of the first mattress assembly toward its first transverse end, said indentation being spaced inwardly from the side edges of the first mattress assembly;

a second mattress assembly mounted on said framework for support of the legs and feet of a patient;

said second mattress assembly having parallel transversely spaced side edges spaced so as to present a longitudinal continuation of the side edges of the first mattress assembly and extending between a first transverse end at the foot end of the framework and a second transverse end intermediate the foot and head ends thereof;

a transversely centered projection extending outward from the second transverse end of the second mattress assembly opposite to its first transverse end, said projection being spaced inwardly from the side walls of the second mattress assembly and being complementary to said indentation;

said first and second mattress assemblies each having upwardly facing support surfaces;

said projection being adapted to fit within said indentation when the respective second transverse end edges of the first and second mattress assemblies are in coplanar abutment with one another;

and means for effecting relative movement between the respective second transverse end configurations of the first and second mattress assemblies to thereby remove said projection from within said indentation.

2. A bed as set out in claim 1 wherein said last-named means comprises:

movable supports operatively connected between the framework and the first mattress assembly for selectively raising the second transverse end configuration of said first mattress assembly with respect to the framework to an elevation above that of the complementary second transverse end configuration of said second mattress assembly.

3. A bed as set out in claim 1 wherein said last-named means comprises:

movable supports operatively connected between the framework and the second mattress assembly for selectively lowering the second transverse end configuration of said second mattress assembly with respect to the framework to an elevation below that of the complementary second transverse end configuration of said first mattress assembly.

4. A bed as set out in claim 1 wherein said framework comprises first and second independently constructed bed frame modules;

said first mattress assembly being mounted on said first bed frame module;

said second mattress assembly being mounted on said second bed frame module;

and releasable latch means operatively mounted on said bed frame modules for alternatively attaching a first end of each bed frame module to one another to form a full length bed with the first and second bed frame modules in longitudinal alignment and the respective side edges of the first and second mattress assemblies in longitudinal alignment or for releasing the bed frame modules from one another for movement independent of one another.

5. A combination labor, delivery and patient care bed, comprising:

first and second independently constructed bed frame modules, each having first and second longitudinally spaced ends, each bed frame module having a longitudinal length dimension and a transverse width dimension, each of said bed frame modules including a plurality of corner legs engageable with a floor surface;

said bed frame modules each including a horizontal open framework having a common elevation relative to the floor surface and having a width common to one another;

releasable latch means mounted on said bed frame modules for alternatively attaching the first ends of the modules to one another to form a full length bed or for releasing the bed frame modules from one another for independent movement and usage of the bed frame modules about a floor surface;

a center mattress section movably mounted on said first bed frame module at said first end thereof, said center mattress section having longitudinally spaced lower and upper transverse ends defining the boundaries of a patient support surface thereon;

an upper mattress section movably mounted to said center mattress section about a transverse axis across the upper end of the center mattress section, said upper mattress section having longitudinally spaced lower and upper ends defining the boundaries of an upwardly facing patient engaging surface formed thereon;

a lower mattress section movably mounted on said second bed frame module, said lower mattress section having longitudinally spaced lower and upper transverse ends defining the longitudinal boundaries of an upwardly facing patient engaging surface formed thereon;

and operational means connected between the first bed frame module and said center and upper mattress sections and connected between the second bed frame module and the lower mattress section for selectively locating the respective mattress sections in the following alternative configurations relative to the bed frame modules while the respective bed frame modules remain attached to one another:

(a) a first condition in which the patient engaging surfaces of the upper, center and lower mattress sections are coplanar;

(b) a second condition in which the center mattress section is raised relative to the first bed frame module and lower mattress section to a position in which its lower transverse end is elevationally above the upper transverse end of the lower mattress section;

(c) a third condition in which the lower mattress section is lowered relative to said second bed frame module and center mattress section to a position in which its upper transverse end is elevationally lower than the lower transverse end of said center mattress section;

(d) a fourth condition in which the patient engaging surfaces of said upper mattress section are inclined upwardly and outward in a longitudinal direction leading from the transverse upper end of said center mattress section;

(e) a fifth condition in which the upper and center mattress sections are coplanar and inclined downwardly in a direction leading from the lower end of the center mattress section to the upper transverse end of the upper mattress section.

6. A bed as set out in claim 5 wherein said operational means for locating the mattress assemblies in said first condition comprise:

elevational supports extending upward from the bed frame modules to the upper, center and lower mattress sections respectively when said mattress sections are each coplanar and parallel to the first and second bed frame modules.

7. A bed as set out in claim 5 wherein said operational means for locating the mattress sections in said second condition comprise:

rigid braces pivotally mounted between the first bed frame module and said center mattress section;

and selectively operable motion transmitting means connected between the first bed frame module and the center mattress section for raising or lowering the center mattress section relative to the first bed frame module.

8. A bed as set out in claim 5 wherein the operational means for locating the mattress sections in said third condition comprise:

a pivotal connection between the lower transverse end of the lower mattress section and said second bed frame module;

and movable support means mounted between the upper end of the lower mattress section and said second bed frame module for permitting elevational movement between said upper end and the second bed frame module.

9. A bed as set out in claim 5 wherein the operational means for locating the mattress assemblies in said fourth condition comprise:

a pivotal connection between the upper mattress section and the center mattress section about a transverse horizontal axis at the upper transverse edge of the center mattress section;

and motion transmitting means operatively connected between the upper mattress section and center mattress section for angularly positioning the upper mattress section with respect to the center mattress section about said axis.

10. A combination labor, delivery and patient care bed, comprising:

first and second independently constructed bed frame modules, each having first and second longitudinally spaced ends, each bed frame module having a longitudinal length dimension and a transverse width dimension, each of said bed frame modules including leg means for engagement with a floor surface;

releasable latch means mounted on said bed frame modules for alternatively attaching the first ends of the modules to one another to form a full length bed or for releasing the bed frame modules from one another for independent movement and usage of the bed frame modules about a floor surface;

a center mattress section mounted on said first bed frame module at said first end thereof, said center mattress section having longitudinally spaced lower and upper transverse ends defining the boundaries of an upwardly facing patient support surface thereon;

an upper mattress section movably mounted to said center mattress section about a transverse axis across the upper end of the center mattress section, said upper mattress section having longitudinally spaced lower and and upper ends defining the boundaries of an upwardly facing patient engaging surface formed thereon;

a lower mattress section mounted on said second bed frame module, said lower mattress section having longitudinally spaced lower and upper transverse ends defining the longitudinal boundaries of an upwardly facing patient engaging surface formed thereon;

and operational means connected between the first bed frame module and said center and upper mattress sections for selectively locating the respective mattress sections in the following alternative configurations relative to the bed frame modules while the respective bed frame modules remain attached to one another;

(a) a first condition in which the patient engaging surfaces of the upper, center and lower mattress sections are coplanar;

(b) a second condition in which the center mattress section is raised relative to the first bed frame module and lower mattress section to a position in which its lower transverse end is elevationally above the upper transverse end of the lower mattress section; and (c) a third condition in which the patient engaging surfaces of said upper mattress section are inclined upwardly in a longitudinal direction leading from the transverse upper end of said center mattress section.

11. A bed as set out in claim 10 wherein said operational means is further capable of selectively locating the respective mattress sections in a fourth condition in which the upper and center mattress sections are coplanar and inclined downwardly in a direction leading from the lower end of the center mattress section to the upper transverse end of the upper mattress section.

12. A bed as set out in claim 10 wherein the lower transverse end of said center mattress section includes a central indentation extending inwardly therefrom and wherein the upper transverse end of said lower mattress section includes a complementary projection extending outward therefrom, said projection being adapted to fit within said indentation when the respective transverse end configuration including them are in coplanar abutment with one another.

* * * * *